US012434283B2

(12) United States Patent
Sugimoto et al.

(10) Patent No.: US 12,434,283 B2
(45) Date of Patent: Oct. 7, 2025

(54) HOT ROLLING MILLS AND HOT ROLLING METHODS

(71) Applicant: PRIMETALS TECHNOLOGIES JAPAN, LTD., Hiroshima (JP)

(72) Inventors: Tatsunori Sugimoto, Hiroshima (JP); Kenji Horii, Hiroshima (JP); Akio Kuroda, Hiroshima (JP); Akira Sako, Hiroshima (JP); Shinya Kanemori, Tokyo (JP)

(73) Assignee: PRIMETALS TECHNOLOGIES JAPAN, LTD., Hiroshima (JP)

( * ) Notice: Subject to any disclaimer, the term of this patent is extended or adjusted under 35 U.S.C. 154(b) by 214 days.

(21) Appl. No.: 17/914,779

(22) PCT Filed: Apr. 27, 2020

(86) PCT No.: PCT/JP2020/018022
§ 371 (c)(1),
(2) Date: Sep. 27, 2022

(87) PCT Pub. No.: WO2021/220367
PCT Pub. Date: Nov. 4, 2021

(65) Prior Publication Data

US 2023/0139351 A1 May 4, 2023

(51) Int. Cl.
*B21B 13/02* (2006.01)
*B21B 1/26* (2006.01)
*B21B 13/14* (2006.01)

(52) U.S. Cl.
CPC ..... *B21B 1/26* (2013.01); *B21B 13/02* (2013.01); *B21B 2013/025* (2013.01); *B21B 13/14* (2013.01); *B21B 2269/04* (2013.01)

(58) Field of Classification Search
CPC ..... B21B 13/02; B21B 13/023; B21B 13/14; B21B 29/00
See application file for complete search history.

(56) References Cited

U.S. PATENT DOCUMENTS 6,592,265 B1 * 7/2003 Rossi ..... F16C 19/55 384/619
2003/0019271 A1 1/2003 Yamamoto et al.
(Continued)

FOREIGN PATENT DOCUMENTS

CA 2350534 A1 5/2000
JP 58-23161 B2 11/1980
(Continued)

OTHER PUBLICATIONS

International Search Report of PCT/JP2020/018022 dated Jun. 30, 2022.

*Primary Examiner* — Debra M Sullivan
(74) *Attorney, Agent, or Firm* — MATTINGLY & MALUR, PC

(57) ABSTRACT

A hot rolling mill 1 includes a control apparatus 20 that adjusts an angle formed between an upper-side pair of an upper backup roll 120A and an upper work roll 110A and a lower-side pair of a lower backup roll 120B and a lower work roll 110B in a state where the upper-side pair is kept parallel and in a state where the lower-side pair is kept parallel. The hot rolling mill 1 is configured such that the work rolls 110A and 110B satisfy the condition that DW/Lb is equal to or smaller than 0.30 where DW is a diameter of the work rolls 110A and 110B, and Lb is the maximum strip width of a rolled material, and the hot rolling mill 1 performs rolling in a state where a bending force is applied to the work rolls.

5 Claims, 10 Drawing Sheets

(56) References Cited

U.S. PATENT DOCUMENTS

| | | | | |
|---|---|---|---|---|
| 2017/0008055 | A1* | 1/2017 | Norikura | B21B 37/58 |
| 2019/0047028 | A1* | 2/2019 | Sako | B21B 37/28 |

FOREIGN PATENT DOCUMENTS

| | | | |
|---|---|---|---|
| JP | 61-202704 | A | 9/1986 |
| JP | 4-253508 | A | 9/1992 |
| JP | 2002-529250 | A | 9/2002 |
| JP | 2003-11221 | A2 | 4/2003 |

* cited by examiner

HOT ROLLING MILLS AND HOT ROLLING METHODS

TECHNICAL FIELD

The present invention relates to hot rolling mills and hot rolling methods.

BACKGROUND ART

Patent Document 1 discloses that a pair of an upper work roll and an upper backup roll and a pair of a lower work roll and a lower backup roll are inclined along a strip material surface around the vertical centerline of a rolling mill, further the centerline of the strip material is offset from the vertical centerline of the rolling mill by a certain distance, and the inclination angles of the pairs of rolls described above, gaps formed between left and right ends of the work rolls described above and bending forces applied to left and right roll shafts of the work rolls are adjusted according to conditions at a time of rolling set on the basis of dimensional data such as the strip width/strip thickness of a rolling-subject strip material, the quality of the material such as a normal steel/special steel and the amount of the offset described above to roll the strip material into a predetermined cross-sectional shape. Thereby, the lifetime of the upper and lower work rolls is extended to be twice or more than that in conventional technologies.

PRIOR ART DOCUMENT

Patent Document

Patent Document 1: JP-S58-23161-B

SUMMARY OF THE INVENTION

Problem to be Solved by the Invention

Roll-cross four-high rolling mills that control the strip crown and the strip shape by causing upper and lower rolls to cross are generally classified into pair cross mills and work-roll cross mills. These two types have been developed, and it is known that these types allow wide control ranges.

Pair cross mills adopt a method in which, as described in Patent Document 1, a work roll and a backup roll are treated as a pair, and the axes of a set of pairs of rolls are caused to cross each other on a horizontal plane to thereby control the strip crown and the strip shape.

In a typical batch roll method, the pair cross angle is preset, and control during rolling is performed through work-roll bending in most cases. However, for a case of long rolling campaign as in endless rolling, dynamic pair cross mills that change the pair cross angles during rolling have been put to practical use.

Here, in a typical hot rolling process, in order to perform strip shape control of a second-order component that reaches the strip center by work-roll bending during rolling, the ratio $D_w/L_b$ between the work-roll diameter $D_w$ and the maximum strip width $L_b$ is set greater than 0.30, and the minimum level of the ratio has been 0.32 in terms of the work-roll maximum diameter of a pair cross mill.

Accordingly, despite the fact that work roll bending and a roll cross method like a pair cross method or a work-roll cross method are combined to perform control, both of them perform low-order shape control close to second-order shape control, and there is not a significant difference in terms of order, thus complicated shapes like quarter buckle cannot be controlled.

The present invention provides hot rolling mills and hot rolling methods that are capable of controlling complicated shapes as compared with conventional technologies.

Means for Solving the Problem

The present invention includes a plurality of means for solving the problems described above, and an example thereof is a hot rolling mill including: a pair of upper and lower work rolls; a pair of upper and lower backup rolls that support the work rolls; bending actuators that apply bending forces to the work rolls; work-roll horizontal actuators that move the work rolls in a horizontal direction; backup-roll horizontal actuators that move the backup rolls in the horizontal direction; and an angle control apparatus that adjusts an angle formed between an upper-side pair of the upper backup roll and the upper work roll and a lower-side pair of the lower backup roll and the lower work roll in a state where the upper-side pair is kept parallel and in a state where the lower-side pair is kept parallel, in which the work rolls satisfy a condition that $D_w/L_b$ is equal to or smaller than 0.30 where $D_w$ is a diameter of the work rolls, and $L_b$ is a maximum strip width of a rolled material.

Advantages of the Invention

According to the present invention, it is possible to control complicated shapes as compared with conventional technologies. Problems, configurations and advantages other than those described above are made clear by the following explanation of an embodiment.

MODE FOR CARRYING OUT THE INVENTION

Figure 1:
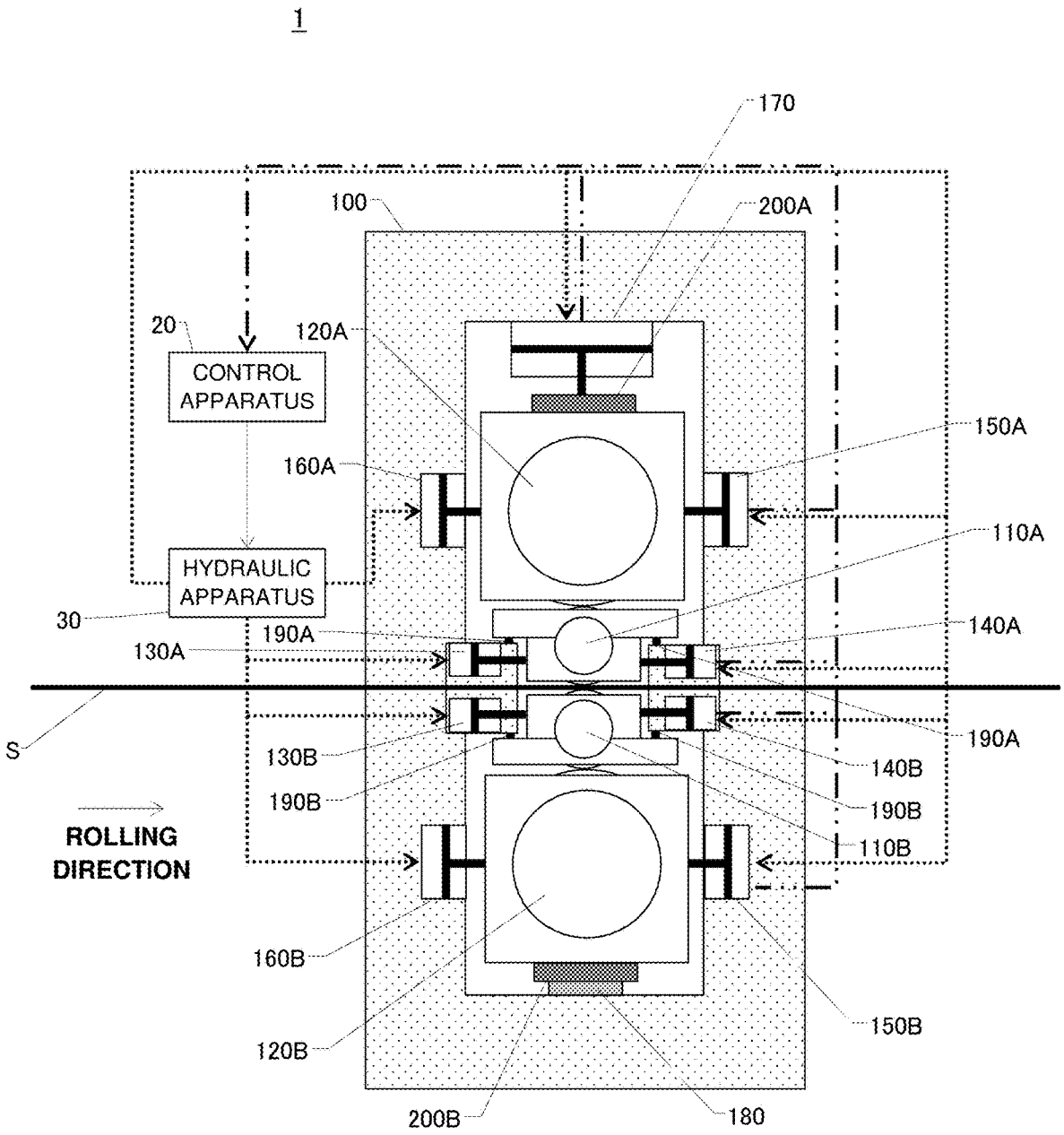
FIG. 1 is a side view depicting the apparatus configuration of a rolling mill according to an embodiment of the present invention.

An embodiment of hot rolling mills and hot rolling methods according to the present invention is explained by using FIG. 1 to FIG. 10.

Note that identical or corresponding constituent elements in the figures used in the present specification are given identical or similar reference characters, and repetitive explanations of these constituent elements are omitted in some cases.

In addition, in the following embodiment and figures, a drive side (also written as a "DS (Drive Side)") means a side where electric motors to drive work rolls are installed when a rolling mill is seen from its front side, and a work side ("WS (Work Side)") means the opposite side.

Figure 2:
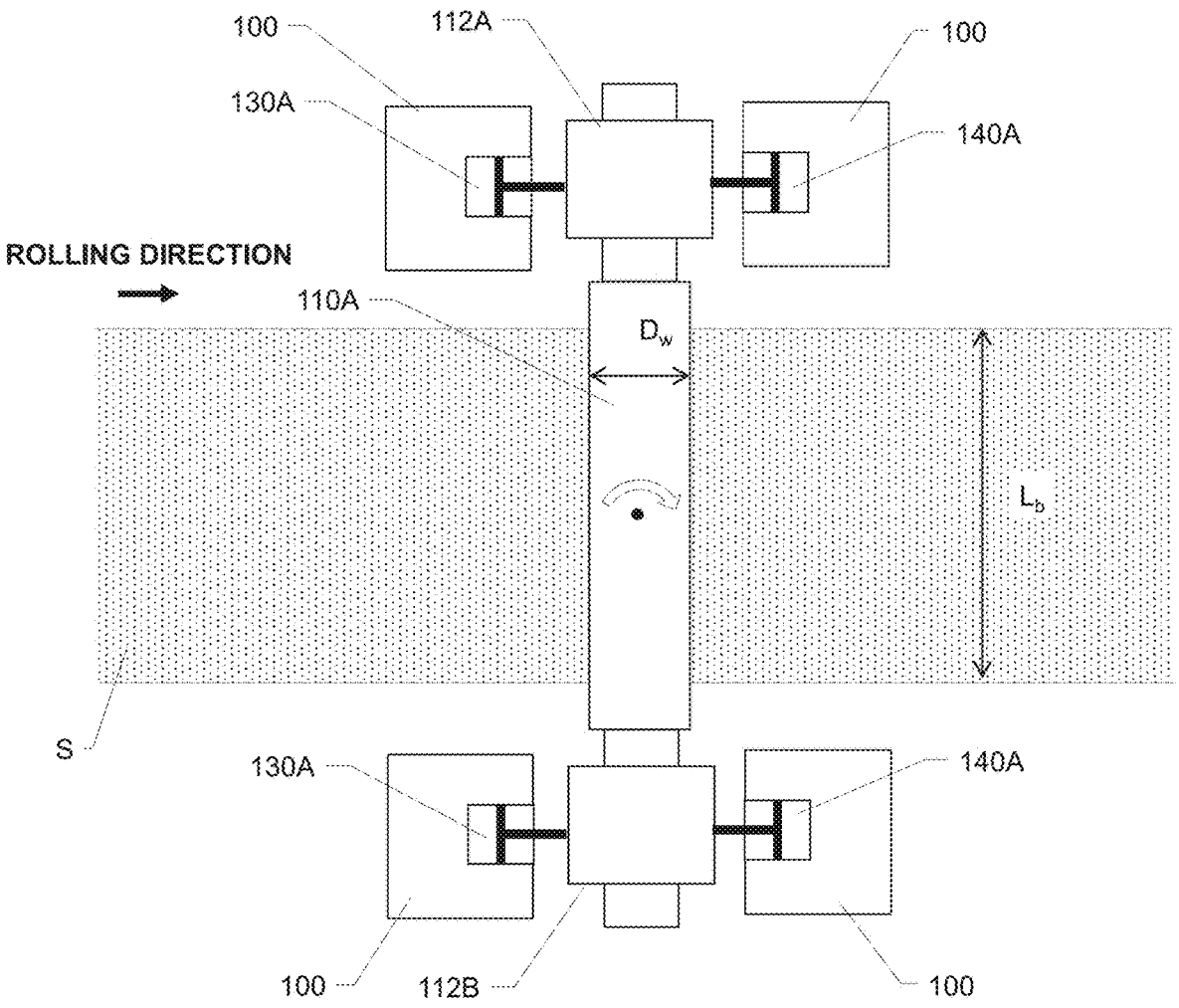
FIG. 2 is a top view depicting an overview of the configuration of equipment around an upper work roll in the rolling mill depicted in FIG. 1.

First, the overall configuration of a hot rolling mill is explained by using FIG. 1 and FIG. 2. FIG. 1 is a side view of the rolling mill according to the present embodiment, and FIG. 2 is a top view depicting an overview of the configuration of equipment around an upper work roll in the rolling mill depicted in FIG. 1.

In FIG. 1, a hot rolling mill 1 is a Roll-cross four-high rolling mills that rolls a rolled material S, and has a housing 100, a control apparatus 20, and a hydraulic apparatus 30. Note that the rolling mill is not limited to a one-stand rolling mill like the one depicted in FIG. 1, and may be a rolling mill including two stands or more.

The housing 100 includes a pair of an upper work roll 110A and a lower work roll 110B that are provided on the upper side and lower side, a pair of an upper backup roll 120A and a lower backup roll 120B that support the work rolls 110A and 110B, and are provided on the upper side and lower side.

Hydraulic cylinder apparatuses 170 are cylinders that apply rolling forces to the upper backup roll 120A, the upper work roll 110A, the lower work roll 110B, and the lower backup roll 120B by pressing the upper backup roll 120A. The hydraulic cylinder apparatuses 170 are provided on the work side and drive side of the housing 100.

A load cell 180 is provided at a lower portion of the housing 100, as rolling force measurement means for measuring a rolling force on the rolled material S applied by the work rolls 110A and 110B, and outputs measurement results to the control apparatus 20.

Upper work-roll bending cylinders 190A are provided on the entry side and exit side of the housing 100 on each of the work side and the drive side. By being driven as appropriate, the upper work-roll bending cylinders 190A apply bending forces vertically to bearings of the upper work roll 110A.

Similarly, lower work-roll bending cylinders 190B are provided on the entry side and exit side of the housing 100 on each of the work side and the drive side, and by being driven as appropriate, the lower work-roll bending cylinders 190B apply bending forces vertically to bearings of the lower work roll 110B.

A backup-roll sliding apparatus 200A is provided at a portion vertically above the upper backup roll 120A, and a backup-roll sliding apparatus 200B is provided at a portion vertically below the lower backup roll 120B.

The hydraulic apparatus 30 is connected to hydraulic cylinders of work-roll pressing apparatuses 130A and 130B and work-roll position control apparatuses 140A and 140B, to hydraulic cylinders of backup-roll pressing apparatuses 150A and 150B and backup-roll position control apparatuses 160A and 160B, and furthermore to the work-roll bending cylinders 190A and 190B also. Note that parts of communication lines and hydraulic-fluid supply lines are omitted in FIG. 1 for convenience of illustration.

The control apparatus 20 receives input of measurement signals from the load cell 180 and position measuring instruments of the work-roll position control apparatuses 140A and 140B and backup-roll position control apparatuses 160A and 160B.

The control apparatus 20 actuation-controls the hydraulic apparatus 30, and supplies and discharges a hydraulic fluid to and from the hydraulic cylinders of the work-roll pressing apparatuses 130A and 130B and work-roll position control apparatuses 140A and 140B to thereby control actuation of the work-roll pressing apparatuses 130A and 130B and the work-roll position control apparatuses 140A and 140B.

Similarly, the control apparatus 20 actuation-controls the hydraulic apparatus 30, and supplies and discharges a hydraulic fluid to and from the hydraulic cylinders of the backup-roll pressing apparatuses 150A and 150B and backup-roll position control apparatuses 160A and 160B to thereby control actuation of the backup-roll pressing apparatuses 150A and 150B and the backup-roll position control apparatuses 160A and 160B.

Due to the actuation control, the control apparatus 20 controls angle adjustment by the work-roll pressing apparatuses 130A and 130B and work-roll position control apparatuses 140A and 140B, and angle adjustment by the backup-roll pressing apparatuses 150A and 150B and backup-roll position control apparatuses 160A and 160B.

Furthermore, the control apparatus 20 supplies and discharges a hydraulic fluid to and from the work-roll bending cylinders 190A and 190B to thereby control actuation of the work-roll bending cylinders 190A and 190B.

Next, configuration related to the upper work roll 110A is explained by using FIG. 2. Note that since the upper backup roll 120A, the lower work roll 110B, and the lower backup roll 120B also have configuration equivalent to the configuration of the upper work roll 110A, and detailed explanations thereof are approximately the same as the explanation about the upper work roll 110A, the explanations thereof are omitted.

As depicted in FIG. 2, there is the housing 100 on both end sides of the upper work roll 110A of the hot rolling mill 1, and is provided to stand perpendicular to the roll shaft of the upper work roll 110A.

The upper work roll 110A is rotatably supported by the housing 100 via a work-side roll chock 112A and a drive-side roll chock 112B.

A work-roll pressing apparatus 130A, on each of the work side and the drive side, is arranged between the entry side of the housing 100 and the work-side roll chock 112A or the drive-side roll chock 112B, and presses the roll chock 112A of the upper work roll 110A in the rolling direction at a predetermined pressure.

A work-roll position control apparatus 140A, on each of the work side and the drive side, is arranged between the exit side of the housing 100 and the work-side roll chock 112A or the drive-side roll chock 112B, and has a hydraulic cylinder (pressing apparatus) that presses the roll chock 112A of the upper work roll 110A in the direction opposite to the rolling direction. The work-roll position control apparatus 140A includes a position measuring instrument (illustration omitted) that measures the amount of operation of the hydraulic cylinder, and controls the position of the hydraulic cylinder.

Here, a position control apparatus means the apparatus that measures the oil column position of a hydraulic cylinder as a pressing apparatus by using a position measuring instrument incorporated in the position control apparatus, and controls the oil column position until the oil column reaches a predetermined oil column position.

These work-roll pressing apparatuses 130A and 130B, backup-roll pressing apparatuses 150A and 150B and position control apparatuses 140A, 140B, 160A and 160B play a role of an angle adjustor that adjusts the roll cross angle.

Note that whereas FIG. 1 and FIG. 2 depict an example in which hydraulic apparatuses are used as the work-roll position control apparatuses 140A and 140B and the backup-roll position control apparatuses 160A and 160B which are actuators of crossing apparatuses, they are not limited to hydraulic apparatuses, and apparatus with electric configuration or the like can be used.

In addition, whereas the pressing apparatuses are disposed on the entry side of the rolled material S, and the position control apparatuses are disposed on the exit side of the rolled material S in the depicted mode, they may be disposed on the opposite sides in some cases, and the arrangement is not limited to a pattern depicted in FIG. 1 or FIG. 2.

Furthermore, whereas FIG. 1 and FIG. 2 depict an example in which the pressing apparatuses are provided opposite the position control apparatuses, this is not essential, and only the position control apparatuses are provided in other possible configuration. It should be noted that installation of the pressing apparatuses makes it possible to eliminate backlashes between the roll chocks 112A and 112B and the housing 100, and to stabilize the horizontal positions of the roll chocks 112A and 112B.

Next, characteristic configuration of the rolling mill according to the present embodiment is explained with reference to FIG. 3 to FIG. 10.

Figure 3:
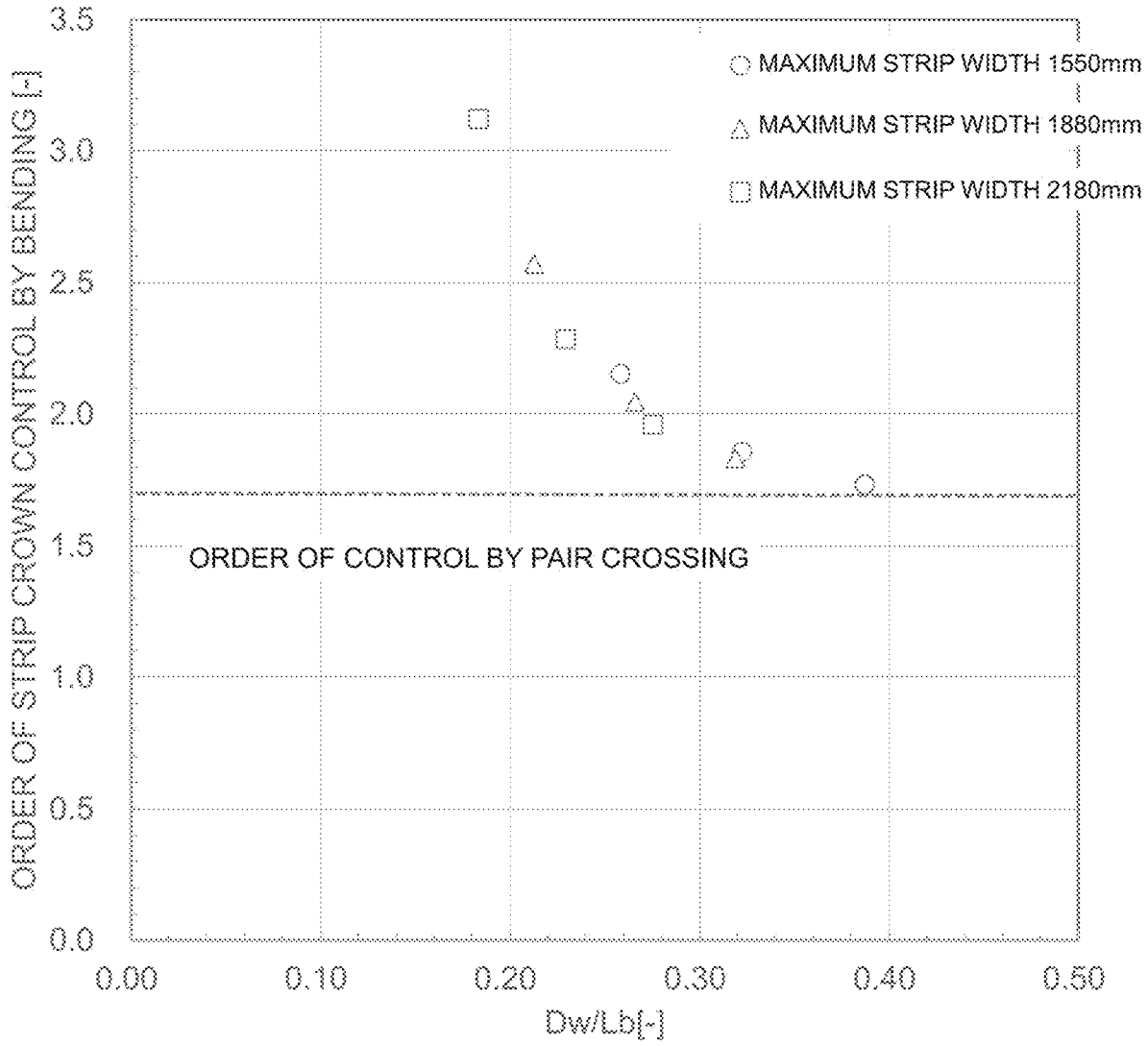
FIG. 3 is a figure depicting how changes in the strip crown control order due to differences of the work-roll diameter appear in the rolling mill according to the embodiment.
Figure 4:
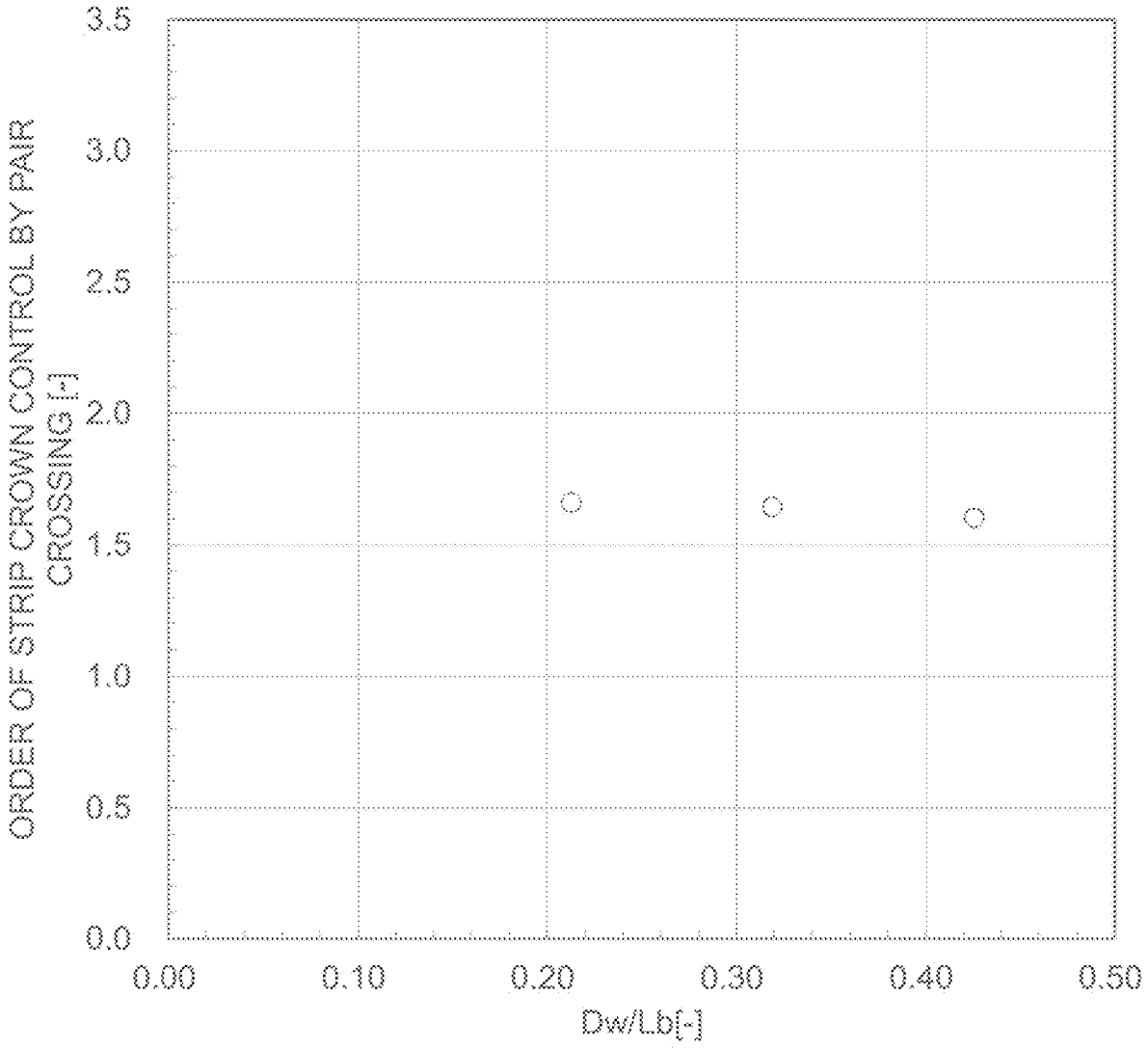
FIG. 4 is a figure depicting how a work-roll diameter influences the order of control by pair crossing in the rolling mill according to the embodiment.
Figure 5:
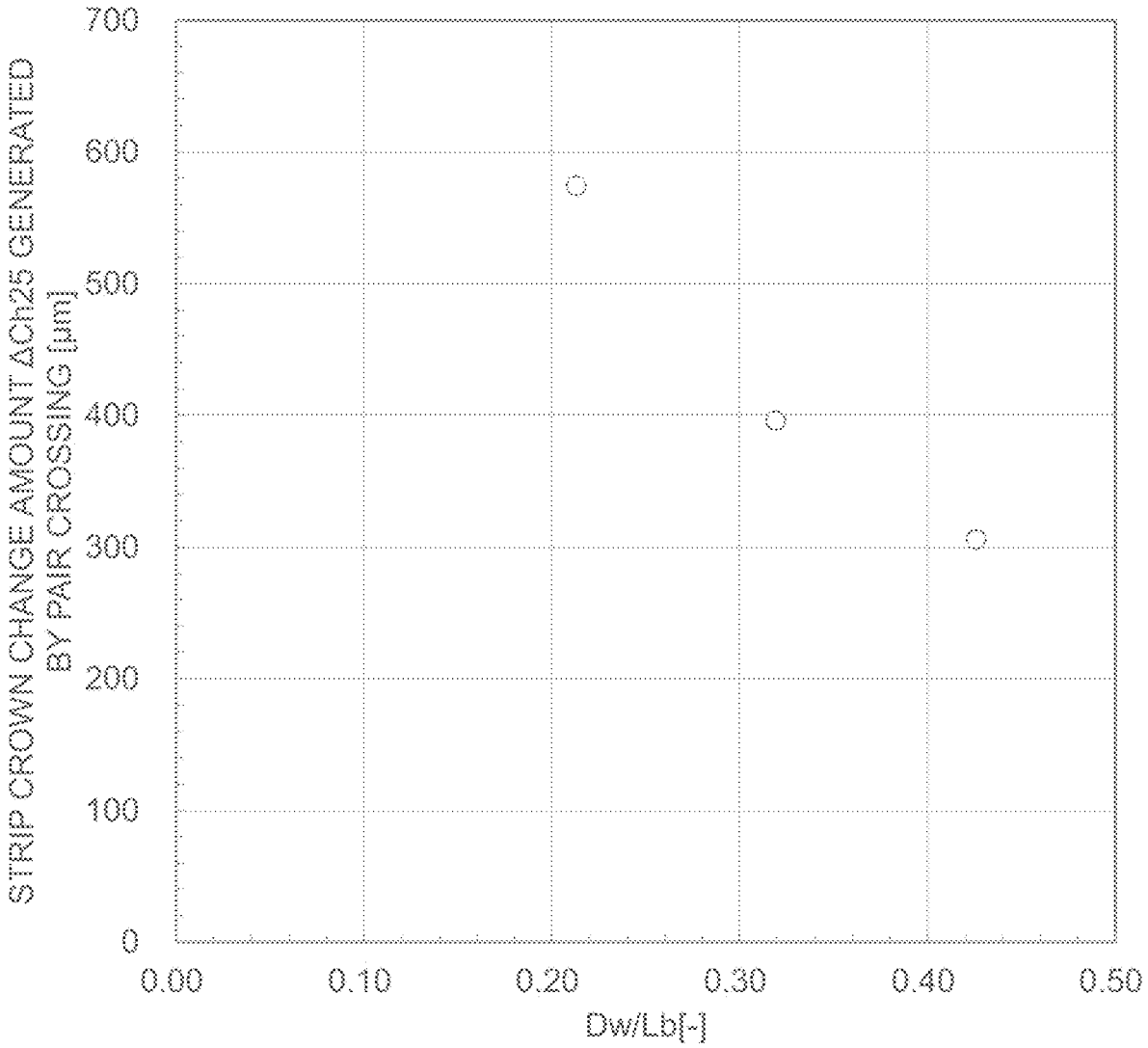
FIG. 5 is a figure depicting how a work-roll diameter influences strip crown change amounts generated by pair crossing in the rolling mill according to the embodiment.
Figure 6:
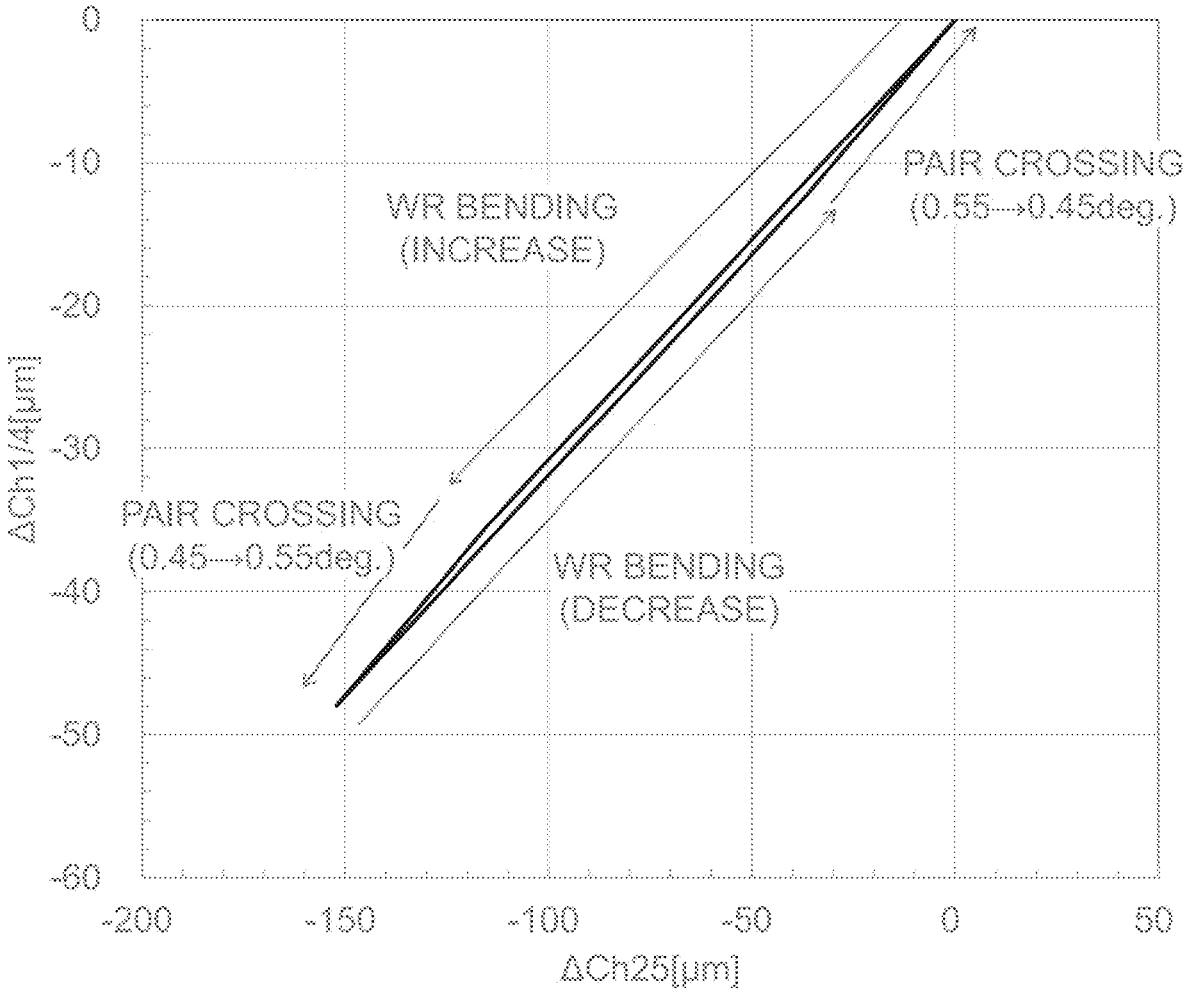
FIG. 6 is a figure depicting crown control ranges in a rolling mill according to a reference example.
Figure 7:
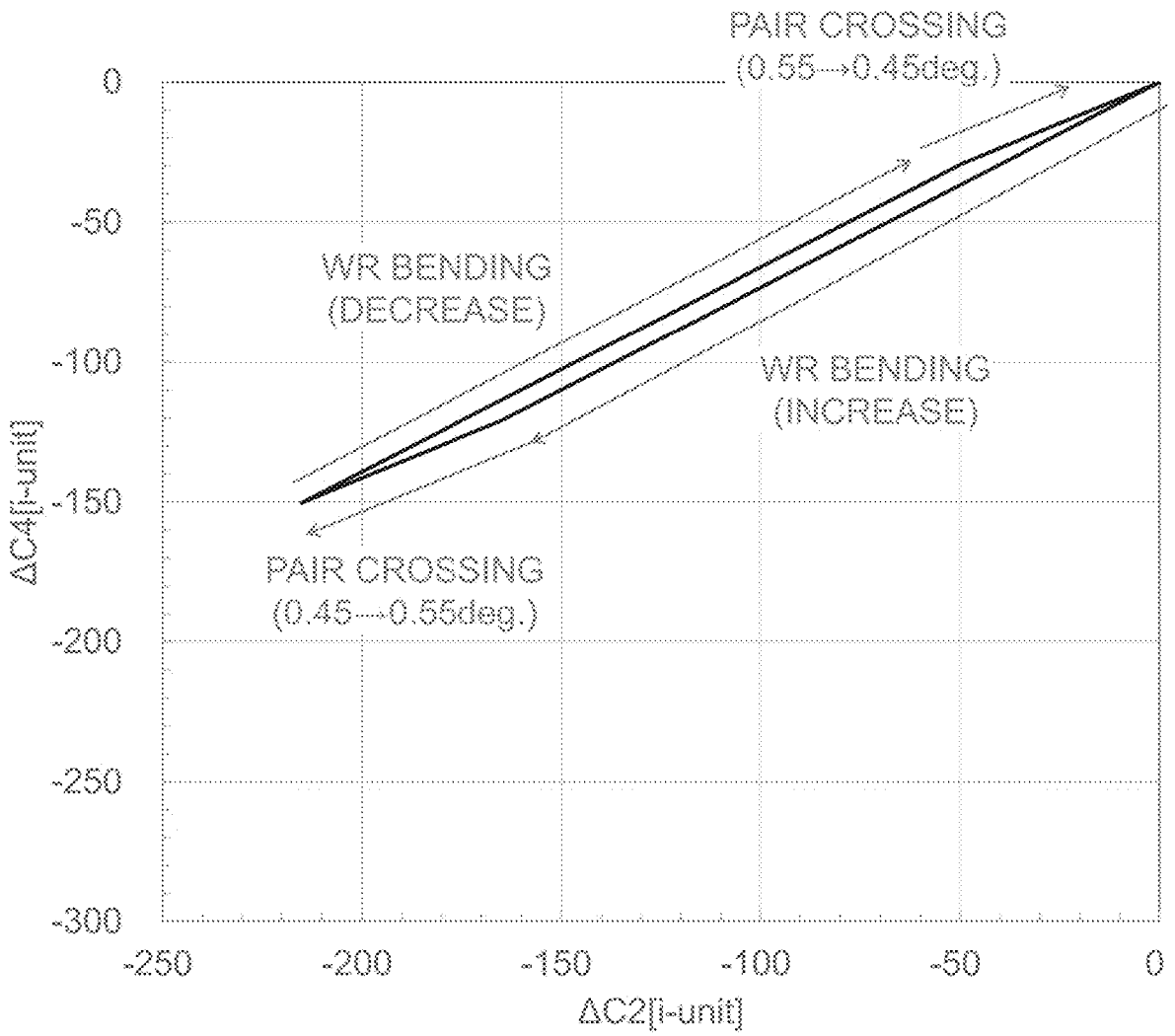
FIG. 7 is a figure depicting shape control ranges in the rolling mill according to the reference example.
Figure 8:
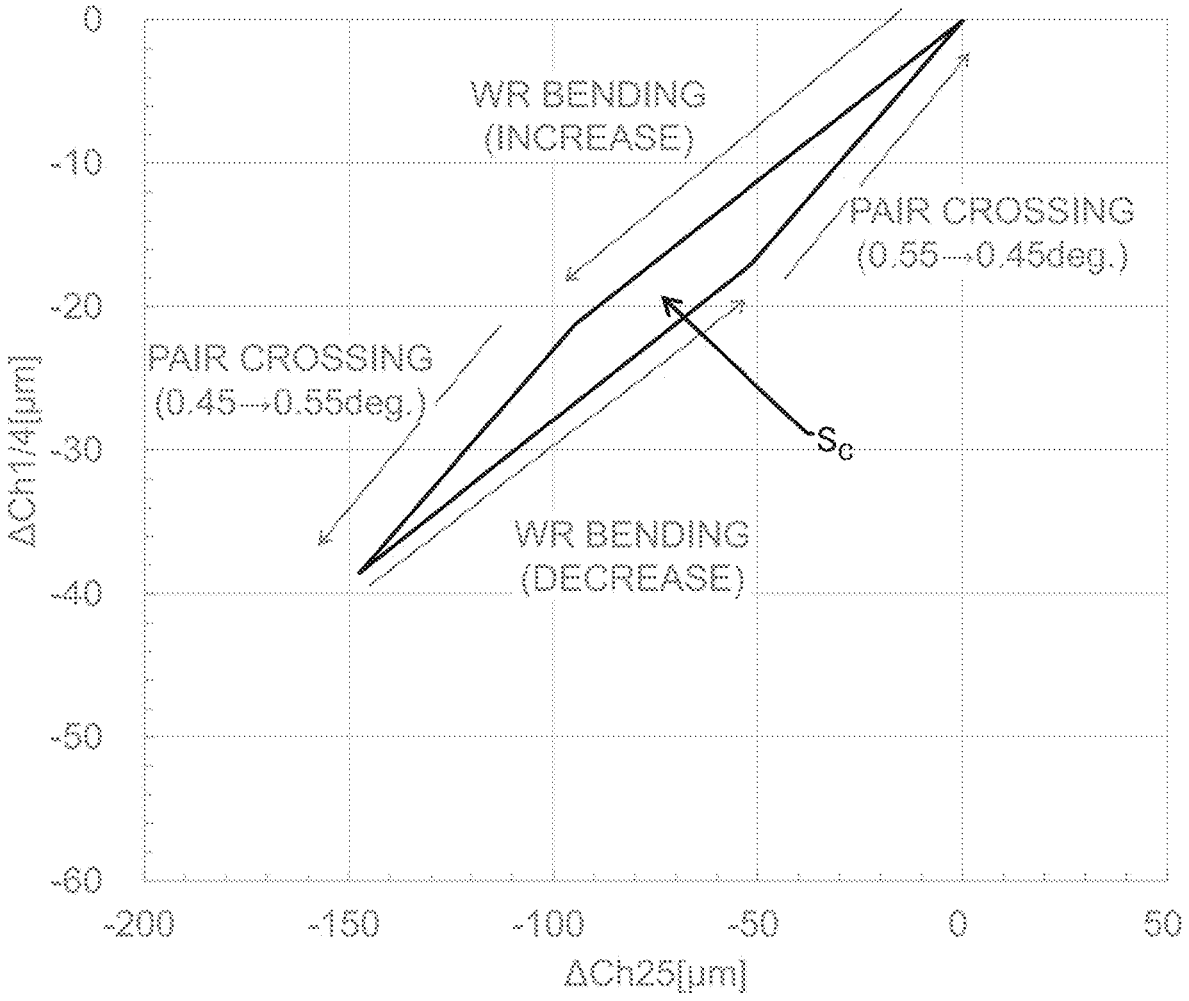
FIG. 8 is a figure depicting crown control ranges in the rolling mill according to the embodiment.
Figure 9:
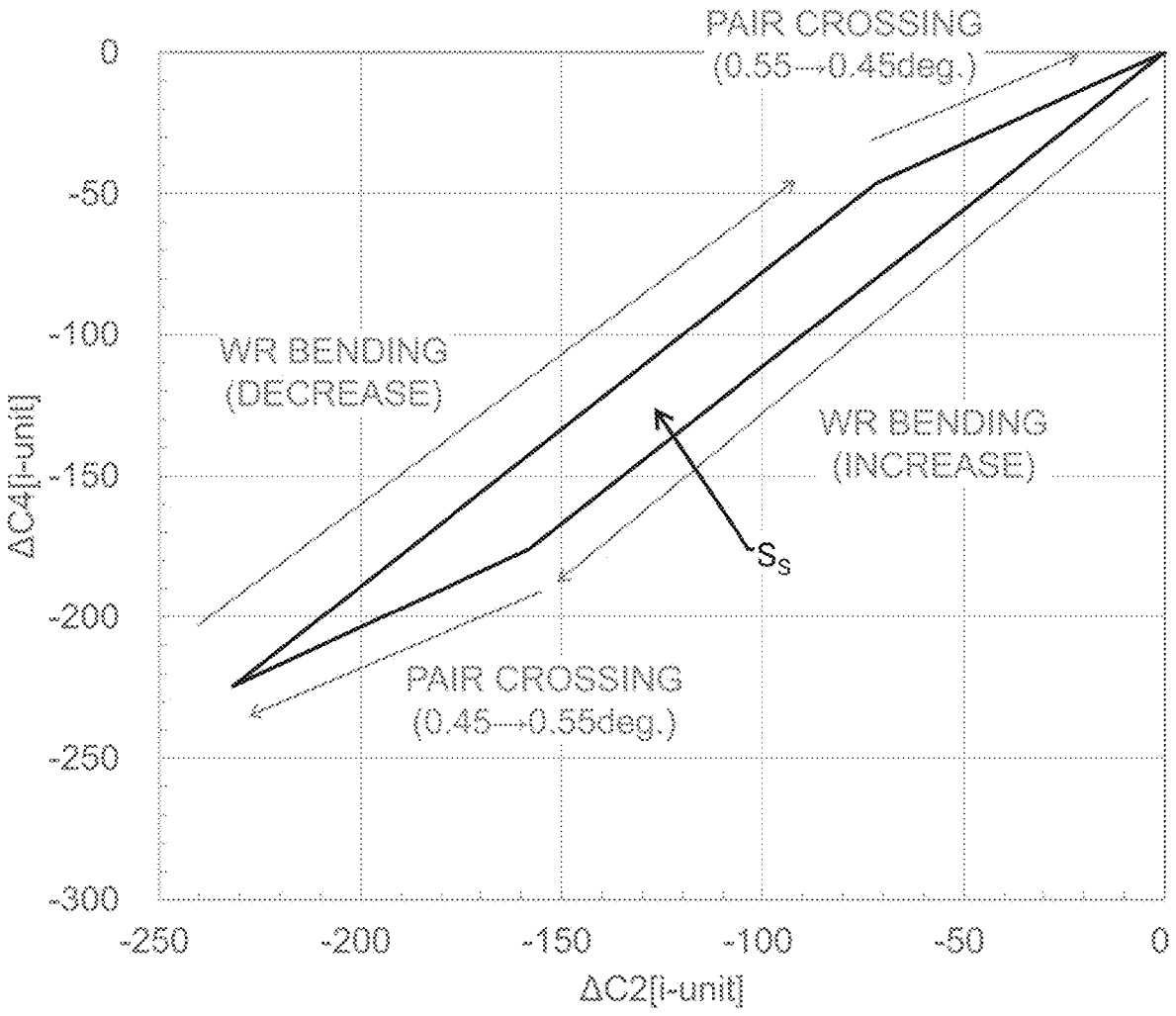
FIG. 9 is a figure depicting shape control ranges in the rolling mill according to the embodiment.
Figure 10:
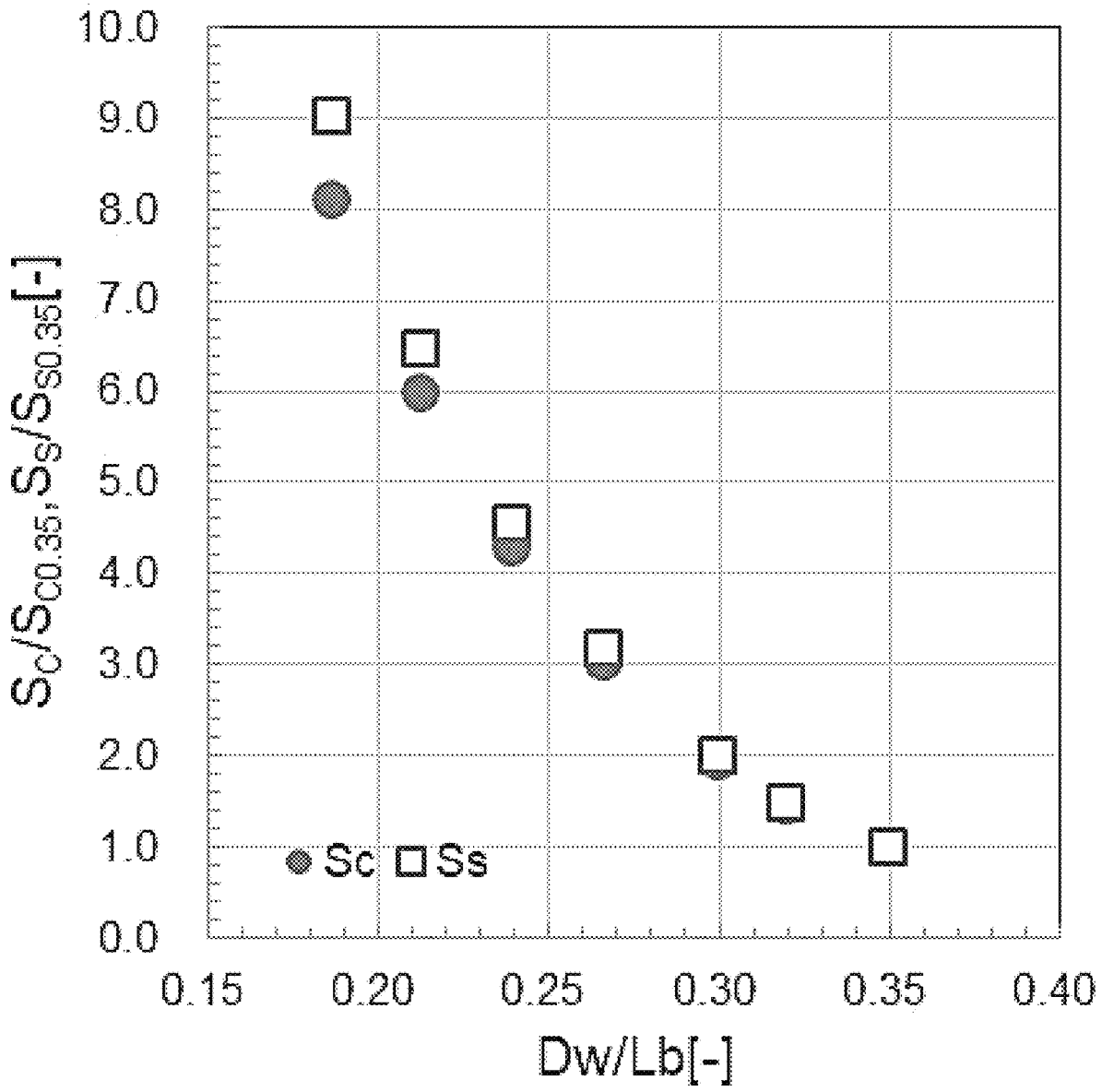
FIG. 10 is a figure depicting influence of $D_w/L_b$ on crown control and shape control ranges in the rolling mill according to the embodiment.

FIG. 3 is a figure depicting how changes in the strip crown control order due to differences of the work-roll diameter appear. FIG. 4 is a figure depicting how a work-roll diameter influences the order of control by pair crossing. FIG. 5 is a figure depicting how a work-roll diameter influences strip crown change amounts generated by pair crossing. FIG. 6 is a figure depicting crown control ranges in a rolling mill according to a reference example. FIG. 7 is a figure depicting shape control ranges. FIG. 8 is a figure depicting crown control ranges in the rolling mill according to the embodiment. FIG. 9 is a figure depicting shape control ranges. FIG. 10 is a figure depicting influence of $D_w/L_b$ on crown control and shape control ranges.

In the hot rolling mill according to the present embodiment, the work rolls 110A and 110B satisfy the condition that $D_w/L_b$ is equal to or smaller than 0.30, and more suitably satisfy the condition that $D_w/L_b$ is equal to or greater than 0.15 and the condition that $D_w/L_b$ is equal to or smaller than 0.28 where $D_w$ is the diameter of the work rolls 110A and 110B, and $L_b$ is the maximum strip width of the rolled material S.

In addition, the control apparatus 20 adjusts the angle formed between the upper-side pair of the upper backup roll 120A and the upper work roll 110A and the lower-side pair of the lower backup roll 120B and the lower work roll 110B in a state where the upper-side pair is kept parallel and in a state where the lower-side pair is kept parallel, and rolling is performed in this so-called pair-cross state. The angle adjustment in this pair-cross state is executed during the rolling. Note that the adjustment can be performed not during the rolling but before the start of the rolling.

Furthermore, the rolling is performed in a state where bending forces are applied to the work rolls 110A and 110B.

Details of a limitation of the range of $D_w/L_b$ is explained below.

In typical cross mills, the ratio $D_w/L_b$ between the work-roll diameter $D_w$ and the maximum strip width $L_b$ is within the range of 0.32 or greater, and the control order in this range is generally 1.7 to 1.9. That is, under identical rolling conditions, there is not a significant difference from the control order of cross angle changes which is 1.7.

FIG. 3 and the figures that follow are figures depicting simulation results of change amounts of the strip crown and strip shape under the condition that a rolled material with hardness of 20 kgf/mm$^2$ is 20% rolling reduction ratio into a 2-mm strip. Here, whereas attention is paid to strip shape control, since the strip shape represented by deviation of strip elongation in the lengthwise corresponds to the strip crown, simulation results of the strip crown are depicted here.

FIG. 3 depicts a relation between $D_w/L_b$ and the order of strip crown control by work-roll bending. As depicted in FIG. 3, it can be known that the strip crown control order tends to increase as $D_w/L_b$ decreases.

In addition, as depicted in FIG. 4, it can be known that the order of crown control by pair crossing is approximately 1.7, and the influence of the ratio $D_w/L_b$ between the work-roll diameter $D_w$ and the maximum strip width $L_b$ is extremely small. Although it is considered that this order is slightly influenced by rolling conditions due to roll flattening, roll deflection, or the like, the control order is generally 2.0 irrespective of a work-roll diameter.

In order to control complicated shapes including quarter buckles, it is desirable if not only shapes close to second-order terms are controlled, but control can be performed in combination with a mechanism that controls shapes of higher-order terms that are far from the second-order terms.

Here, as depicted in FIG. 3, orders greater than 1.7, which cannot be achieved with pair crossing, are achieved with work-roll bending in the range of $D_w/L_b$ which is equal to or smaller than 0.30, which is smaller than 0.32.

Accordingly, it has become clear that, by adopting the condition that $D_w/L_b$ is equal to or smaller than 0.30, control orders equal to or greater than 1.9 can be attained with work-roll bending, and by adjustment of angles in a pair-cross state by horizontal actuators, and adjustment of bending load by vertical actuators, control of complicated strip shapes represented by a formula which is a combination of low orders and high orders can be realized.

FIG. 5 depicts results of simulations of a changed roll diameter about crown-Ch25 change amounts ΔCh25 in a case where the pair cross angle is changed from 0° to 1.0° where crown Ch25 is the difference of the strip thickness between the strip center and a 25-mm position from a strip end. As depicted in FIG. 5, it can be known that a geometrically-generated gap increases as the diameter is reduced, thus controllable ranges also widen.

FIG. 6 to FIG. 9 depict results of estimation by simulations of the strip crown control range and the second-order and fourth-order strip shape control ranges.

FIG. 6 and FIG. 7 depict results that are obtained under the condition of: pair cross)(0.45°-0.55°, $D_w$=650 mm and $D_w/L_b$=0.35, and FIG. 8 and FIG. 9 depict results that are obtained under the condition of: pair cross (0.45°-0.55°), $D_w$=450 mm and $D_w/L_b$=0.24.

Then, FIG. 6 and FIG. 8 depict relations of strip crown change amounts ΔCh¼ at a widthwise ¼-position (quarter position) to strip crown change amounts ΔCh25 of a 25-mm position from an end, and FIG. 7 and FIG. 9 depict relations of fourth-order component change amounts ΔC4 to second-order component change amounts ΔC2 of the deviation of longitudinal strain in the rolling direction.

It can be known that, under the conventional range condition of $D_w/L_b$=0.35 depicted in FIG. 6 and FIG. 7, the value of ΔCh¼ relative to ΔCh25, and the value of ΔC4 relative to ΔC2 change at generally equal gradients in both a case where the cross angle of pair crossing is changed, and a case where work-roll bending is increased and reduced, and the ranges within which ΔCh25 and ΔCh¼ and ΔC2 and ΔC4 can be controlled individually are very narrow.

In contrast, as depicted in FIG. 8 and FIG. 9, in a case where a condition of the present invention, $D_w/L_b$=0.24, is adopted, the value of ΔCh¼ relative to ΔCh25, and the value of ΔC4 relative to ΔC2 change at different gradients in a case where the cross angle of pair crossing is changed, and a case where the work-roll bending is increased and reduced. Accordingly, it can be known that the locus that is formed by following an increase in work-roll bending, a change in the pair cross angle from 0.45° to 0.55°, a reduction of work-roll bending, and a change in the pair cross angle from 0.55° to 0.45° in this order gives a parallelogram shape, and the ranges within which ΔCh25 and ΔCh¼, and ΔC2 and ΔC4 can be controlled individually widen significantly.

Here, as indicators of the ranges within which ΔCh25 and ΔCh¼, and ΔC2 and ΔC4 can be controlled individually, respectively, the area size in the parallelogram in the graph of ΔCh25 and ΔCh¼ is defined as $S_c$, and the area size in the parallelogram in the graph of ΔC2 and ΔC4 is defined as Ss. Taking this into consideration, FIG. 10 depicts results of plotting ratios relative to area sizes $S_{c0.35}$ and $S_{S0.35}$ when $D_w/L_b$ is 0.35 in relation to $D_w/L_b$.

As depicted in FIG. 10, it has become clear that, by adopting the condition that $D_w/L_b$=0.28 or smaller as compared with $D_w/L_b$=0.35 as in conventional technologies, a quarter buckle which is approximately twice or more as long can be realized, and the shape controllability can be enhanced significantly.

Here, in hot rolling processes, typically, work rolls are connected to motors and rotation-driven. In that case, if the diameter of the work rolls is reduced, the spindle diameter is reduced, thus transmittable torque also decreases.

Whereas reduction of the diameter of the work rolls reduces rolling torque also, the influence of the reduction of the diameter of the work rolls is more significant on the limitation of torque transmission of spindles. That is, if the diameter of the work rolls is too small, difficulties in terms of mechanical feasibility arise, and it is considered that disadvantages outweigh advantages.

The rolling torque depends on rolling conditions, and it is determined that it is possible to make feasible modes in which advantages outweigh disadvantages by substantially making $D_w/L_b$ at least equal to or greater than 0.15 in typical hot rolling plants. Because of this, it is desirable if the lower limit of $D_w/L_b$ is set to 0.15.

Summarizing what have been described thus far, it is desirable if the range of $D_w/L_b$ is 0.30 or smaller, and more suitably 0.15 or greater and 0.28 or smaller.

Next, advantages of the present embodiment are explained.

The hot rolling mill 1 according to the first embodiment of the present invention mentioned above includes the control apparatus 20 that adjusts the angle formed between the upper-side pair of the upper backup roll 120A and the upper work roll 110A and the lower-side pair of the lower backup roll 120B and the lower work roll 110B in a state where the upper-side pair is kept parallel and in a state where the lower-side pair is kept parallel. The hot rolling mill 1 is configured such that the work rolls 110A and 110B satisfy the condition that $D_w/L_b$ is equal to or smaller than 0.30 where $D_w$ is the diameter of the work rolls 110A and 110B, and $L_b$ is the maximum strip width of a rolled material.

In this manner, because of a finding found by the present inventors for the first time that, by adopting the condition that $D_w/L_b$ is equal to or smaller than 0.30, which means a smaller work-roll diameter than in conventional typical technologies, it becomes possible to use pair crossing for shape control corresponding to low-order terms and use work roll bending for shape control corresponding to higher order terms, an advantage can be obtained that shape control, which could not have been reached with conventional technologies, can be performed.

In addition, to such an advantage, it is possible to improve cross angle control sensitivity, and to enhance control ranges and responsiveness.

Furthermore, it is possible to attain an advantage that the rolling load is reduced due to small-diameter work rolls. Whereas strip shape control requires control performed according to rolling load fluctuations that change during rolling, since it is considered that the rolling load itself decreases, that is, rolling load fluctuations also decrease in proportion to it, this means that strip shapes themselves that need to be controlled during rolling become smaller. Therefore, according to the present invention, it is possible to attain an advantage that product shapes can be enhanced significantly as compared with conventional technologies.

In addition, since the work rolls 110A and 110B satisfy the condition that $D_w/L_b$ is equal to or smaller than 0.28, the order of a term of an approximation formula that can be formed with bending becomes equal to or greater than 2.0, and can be increased further, accordingly, it is possible to attain an advantage that control of more complicated shapes can be performed.

Furthermore, as the diameter of work rolls decreases, one with a shape represented by an approximation formula including higher-order terms can be created; however, as the diameter decreases, the diameter of spindles that transmit the torque to the work rolls decreases also, accordingly, transmittable torque also decreases on the premise of practical materials and motive power; therefore, a practical range can be realized by the work rolls 110A and 110B satisfying the condition that $D_w/L_b$ is equal to or greater than 0.15.

In addition, the control apparatus 20 can execute control for obtaining more desired strip shapes by executing adjustment of the angle between the upper-side pair and the lower-side pair during rolling of the rolled material.

<Others>

Note that the present invention is not limited to the embodiment described above, and includes various modification examples. The embodiment described above are explained in detail in order to explain the present invention in an easy-to-understand manner, and the present invention is not necessarily limited to those including all the configurations explained.

DESCRIPTION OF REFERENCE CHARACTERS

S: Rolled material
1: Hot rolling mill
20: Control apparatus (angle control apparatus)
30: Hydraulic apparatus
100: Housing
110A: Upper work roll
110B: Lower work roll
112A: Work-side roll chock
112B: Drive-side roll chock
120A: Upper backup roll
120B: Lower backup roll
130A, 130B: Work-roll pressing apparatus

140A, 140B: Work-roll position control apparatus
150A, 150B: Backup-roll pressing apparatus
160A, 160B: Backup-roll position control apparatus
170: Hydraulic cylinder apparatus
180: Load cell
190A: Upper work-roll bending cylinder
190B: Lower work-roll bending cylinder
200A, 200B: Backup-roll sliding apparatus

The invention claimed is:

1. A hot rolling mill comprising:

a pair of upper and lower work rolls;

a pair of upper and lower backup rolls that support the work rolls;

bending actuators that apply bending forces to the work rolls;

work-roll horizontal actuators that move the work rolls in a horizontal direction;

backup-roll horizontal actuators that move the backup rolls in the horizontal direction; and an angle control apparatus configured to adjust an angle formed between an upper-side pair of the upper backup roll and the upper work roll and a lower-side pair of the lower backup roll and the lower work roll in a state where the upper-side pair is kept parallel and in a state where the lower-side pair is kept parallel using the work-roll horizontal actuator and the backup-roll horizontal actuator, wherein the work rolls satisfy a condition that DW/Lb is equal to or smaller than 0.30 where DW is a diameter of the work rolls, and Lb is a maximum strip width of a rolled material.

2. The hot rolling mill according to claim 1, wherein the work rolls satisfy a condition that DW/Lb is equal to or smaller than 0.28.

3. The hot rolling mill according to claim 1, wherein the work rolls satisfy a condition that DW/Lb is equal to or greater than 0.15 and equal to or smaller than 0.30.

4. The hot rolling mill according to claim 1, wherein the angle control apparatus is configured to execute adjustment of angles of the upper-side pair and the lower-side pair during rolling of the rolled material.

5. A hot rolling method by a hot rolling mill including:

a pair of upper and lower work rolls;

a pair of upper and lower backup rolls that support the work rolls;

bending actuators that apply bending forces to the work rolls;

work-roll horizontal actuators that move the work rolls in a horizontal direction; and backup-roll horizontal actuators that move the backup rolls in the horizontal direction, the work rolls satisfying a condition that DW/Lb is equal to or smaller than 0.30 where DW is a diameter of the work rolls, and Lb is a maximum strip width of a rolled material, the method comprising:

adjusting an angle formed between an upper-side pair of the upper backup roll and the upper work roll and a lower-side pair of the lower backup roll and the lower work roll in a state where the upper-side pair is kept parallel and in a state where the lower-side pair is kept parallel using the work-roll horizontal actuator and the backup-roll horizontal actuator; and performing rolling in a state where a bending force is applied to the work rolls.

* * * * *